US006034477A

United States Patent [19]

Peeters et al.

[11] Patent Number: 6,034,477

[45] Date of Patent: Mar. 7, 2000

[54] HIGH-PRESSURE DISCHARGE LAMP

[75] Inventors: Eric E. Peeters; Stefan A. Verlee, both of Turnhout, Belgium

[73] Assignee: U.S. Philips Corporation, New York, N.Y.

[21] Appl. No.: 09/207,527

[22] Filed: Dec. 8, 1998

[30] Foreign Application Priority Data

Dec. 16, 1997 [EP] European Pat. Off. ..... 97203957

[51] Int. Cl.[7] ..... H05B 37/00

[52] U.S. Cl. ..... 315/57; 315/60; 315/73

[58] Field of Search ..... 315/DIG. 2, DIG. 5, 315/289, 290, 57, 60, 73

[56] References Cited

U.S. PATENT DOCUMENTS

| | | | |
|---|---|---|---|
| 4,223,247 | 9/1980 | Jacobs et al. | 315/57 |
| 4,910,437 | 3/1990 | Daniels | 315/208 |
| 5,233,273 | 8/1993 | Waki et al. | 315/224 |

*Primary Examiner*—David H. Vu
*Attorney, Agent, or Firm*—F. Brice Faller

[57] ABSTRACT

A high-pressure discharge lamp provided with an outer bulb enclosing a discharge tube accommodates a transformer having primary winding which forms part of a current conductor to one of the main electrodes of the discharge tube. The secondary winding is coupled to an ignition electrode of the discharge tube. Higher ignition voltages can be achieved without increasing the voltage pulse on the outside contacts of the lamp.

9 Claims, 2 Drawing Sheets

HIGH-PRESSURE DISCHARGE LAMP

BACKGROUND OF THE INVENTION

The invention relates to a high-pressure discharge lamp comprising:

- a light-transmitting lamp vessel which is closed in a gastight manner and which is provided with connection points;
- a first electrode and a second electrode which are arranged opposite each other and which are connected to respective connection points, and an ionizable filling in the lamp vessel;
- a light-transmitting outer envelope around the lamp vessel provided with a lamp cap;
- a first and a second external contact at the lamp cap for connecting the lamp to a supply device;
- a first and a second current conductor connecting, respectively, the first and the second electrode via respective connection points to, respectively, the first and the second contact;
- an ignition electrode between the first and the second electrode;
- a voltage-pulse generator in the outer envelope for generating a voltage pulse on the ignition electrode, which generator is connected to the ignition electrode.

Such a high-pressure discharge lamp is known from EP-B-0 477 621 (=U.S. Pat. No. 5,233,273).

In the known lamp, four current conductors enter the outer envelope from the lamp cap which is in open communication with the space in the envelope. An outer envelope which is not sealed from the environment in a gastight manner, however, is objectionable because it does not permit the temperature of the lamp vessel to be optimally regulated and because corrosion-sensitive components of the lamp, such as the parts of the current conductors entering the lamp vessel, are not protected by an inert medium in the outer envelope. On the other hand, it is difficult from the point of view of construction to introduce more than two current conductors into a closed outer envelope through a wall thereof.

A proper temperature control of the lamp vessel is more important as the pressures required in the lamp vessel are higher. An increase of the pressure in the lamp vessel generally leads to an improvement of the luminous efficacy of the lamp. On the other hand, in particular an increase of the noble gas pressure in the lamp vessel leads to an increase of the ignition voltage of the discharge lamp.

For a wide use of lamps having an improved efficacy, it is important to have the disposal of a high-pressure discharge lamp which can suitably be used with on an existing lamp holder.

In the case of a high-pressure discharge lamp known from said U.S. Pat. No. 5,233,273, the primary winding of a transformer in the outer bulb is connected by means of two separate conductors to an ignition circuit in the lamp cap. The secondary winding of this transformer is connected to the ignition electrode. The disadvantage of an ignition circuit arranged in the lamp and/or lamp cap is, inter alia, the high temperatures to which the circuit is exposed. This is important, in particular, for capacitive and semiconductor components which are used in the ignition circuit. A further disadvantage resides in that the realization of a sufficiently high ignition energy requires, in particular, a capacitive component which is relatively voluminous.

U.S. Pat. No. 4,910,437 discloses a high-pressure discharge lamp comprising an outer envelope which is closed in a gastight manner as well as an external ignition electrode which is present around the discharge vessel. A first and a second current conductor and a conductor connected to the ignition electrode are introduced into the outer envelope in a gastight manner. The voltage pulse on the ignition electrode is generated outside the lamp. In accordance with internationally accepted regulations, high-pressure discharge lamps for general lighting applications should ignite reliably at a limited ignition voltage applied to the lamp cap. In the case of a standardized lamp cap of the type E27 and E40, the permissible ignition voltage is 3 kV and 5 kV, respectively. Under specific conditions, the ignition by means of such a high ignition voltage pulse may involve the occurrence of large currents through the contact points. If higher voltage pulses are applied, use must be made of special lamp caps and associated lamp holders. The use of special lamp caps has the important drawback that the lamps used cannot be freely exchanged with existing lamps and they cannot be used on existing lamp holders. Nor is it possible to use these types of lamps as retrofit lamps in existing installations.

On the one hand, the permissible ignition voltage puts limitations on the aim to improve the luminous efficacy of high-pressure discharge lamps, while, on the other hand, it is attractive for general safety purposes if a high-pressure discharge lamp can be ignited with a substantially reduced ignition voltage pulse at otherwise equal lamp properties.

SUMMARY OF THE INVENTION

In accordance with the invention, the outer envelope is closed in a gastight manner and the voltage-pulse generator comprises a transformer having a primary winding of which is arranged within the outer envelope in the first current conductor, and a secondary winding of which has an electrical connection to the ignition electrode.

In the lamp in accordance with the invention, only two current conductors in the outer envelope have to be fed through, while the lamp in the envelope includes means for generating an ignition voltage pulse on the connection points as well as on the ignition electrode. This enables the ignition voltage pulse on the lamp cap to be reduced in a very simple manner, while the ignition voltage of the lamp is maintained. On the other hand, a design space has been created in a simple manner, which can be used to further increase the ignition voltage of the lamp, without the voltage at the external contacts of the lamp cap becoming unacceptably high.

In a favorable embodiment, the primary winding and the secondary winding have an opposite inductive linkage. This has the advantage that the ignition pulse on the ignition electrode and the ignition pulse on the electrodes in the lamp vessel have opposite polarities, so that the available ignition voltage is effectively considerably increased. For example, in the case of a winding ratio of 1:1 between the primary winding and the secondary winding, the available ignition voltage is effectively doubled.

The lamp can be connected to a supply device provided with an ignition circuit or a starter. It is alternatively possible that the lamp itself has starter means which electrically bridges the lamp vessel and the transformer. The starter may consist, for example, of a VDC (voltage dependent capacitor). The starter may be incorporated in the outer envelope or, alternatively, in a lamp cap connected to the envelope.

It has a favorable effect, inter alia, on the price and a long service life of the lamp if the starter includes a glow discharge starter which is arranged within the outer envelope. If a capacitor is arranged in series with the glow discharge starter, the risk of too high peak currents upon closing of the glow discharge starter is precluded. Additionally, this enables the height of the ignition pulse on the outermost contacts to be limited. In such starter means, the ignition voltage is generated, by a sudden change in current in the VDC or glow discharge starter, in the self-inductance, connected in series therewith, of the stabilizer ballast of the supply device of the lamp, causing this voltage to reach the external contacts of the lamp cap.

In a favorable embodiment, a heat-sensitive element is incorporated in the electrical connection between the ignition electrode and the secondary winding, which heat-sensitive element is high-ohmic during stable operation of the lamp. For this purpose, use can be made, for example, of a bimetal switch which, at an increased temperature caused by heat radiated by the lamp vessel, interrupts the connection between the winding and the electrode.

It is convenient if the ignition electrode is a tungsten track on the discharge vessel, and a bimetal element serving as a switch bears against the tungsten track.

In a particular embodiment, the secondary winding of the transformer means in the vicinity of the primary winding is provided around the lamp vessel.

The lamp in accordance with the invention may comprise a lamp vessel, for example, of quartz glass or ceramic, such as monocrystalline or polycrystalline ceramic, such as sapphire or sintered aluminium oxide. Apart from a noble gas, the ionizable filling may include sodium, sodium amalgam or metal halide, if necessary with a buffer gas such as mercury.

The outer envelope, which is made, for example, of glass, such as hard glass or quartz glass, may be, for example, tubular or egg-shaped and carry a lamp cap at one or two ends.

The lamp in accordance with the invention has the advantage that it ignites readily as a result of a relatively high ignition voltage pulse on the ignition electrode, while the voltage on the external contacts of the lamp cap remains limited. This has the additional advantage that, also in the hot state, the lamp can be readily re-ignited. As a result, the ionizable filling of the lamp can withstand a relatively high pressure, which has a favorable effect on the efficiency of the lamp. The ignition electrode may be provided inside or outside the lamp vessel.

DETAILED DESCRIPTION OF THE PREFERRED EMBODIMENTS

Figure 1:
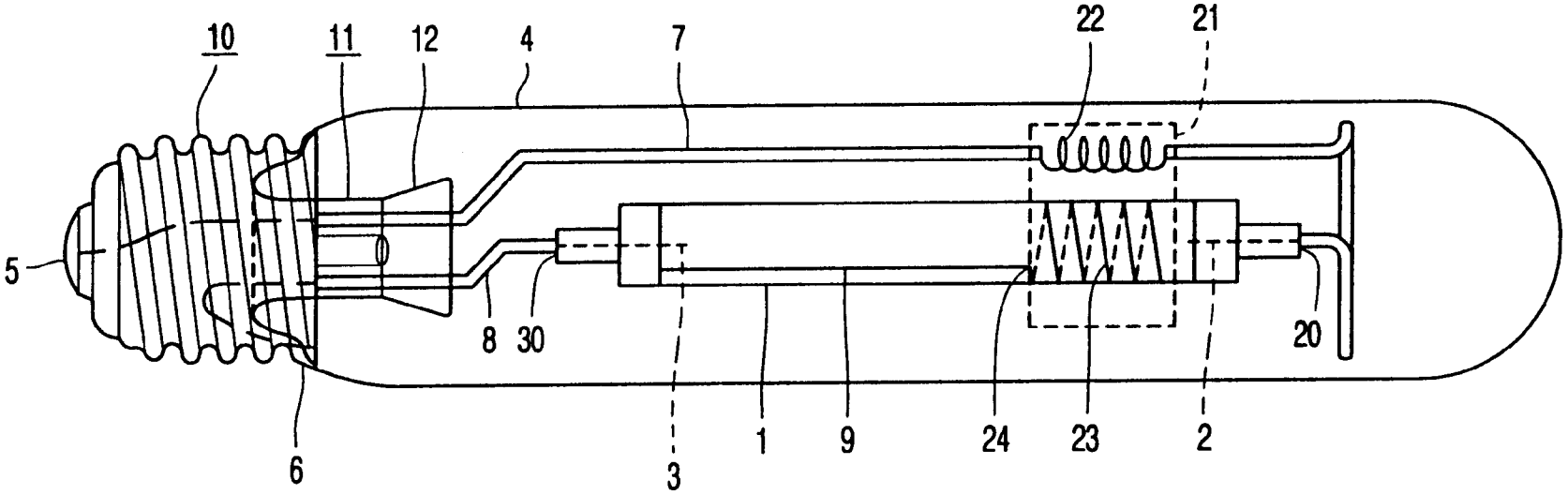
FIG. 1 is a side view of a first embodiment.

FIG. 1 shows a high-pressure discharge lamp which comprises a light-transmitting lamp vessel 1 which is closed in a gastight manner and which accommodates a first electrode 2 and a second electrode 3, which are arranged opposite each other, and which contains an ionizable filling, for example a noble gas and sodium amalgam. The lamp vessel is also provided with connection points 20, 30. A light-transmitting outer envelope 4 provided with a lamp cap 10 surrounds the lamp vessel 1. A first external contact 5 and a second external contact 6 are situated at the lamp cap 10 to enable the lamp to be connected to a supply device. The lamp has a first current conductor 7 and a second current conductor 8 which connect, respectively, the first electrode 2 and the second electrode 3 to, respectively, the first contact 5 and the second contact 6. An external ignition electrode 9 is situated between the first electrode 2 and the second electrode 3, near the lamp vessel 1, in the outer envelope 4. A voltage-pulse generator comprising transformer means 21 for generating a voltage pulse on the ignition electrode 9 is incorporated in the outer envelope 4 and connected to the ignition electrode 9.

The outer envelope 4 is closed in a gastight manner. Within the lamp cap 10, the outer envelope 4 is sealed in a gastight manner to a glass tube 11 which enters the envelope 4 and is closed in the envelope by means of a pinched seal 12. The current conductors 7, 8 pass through the pinched seal 12. The voltage-pulse generator comprises transformer means 21 of which a primary winding 22 is incorporated, within the outer envelope 4, in the first current conductor 7 and of which a secondary winding 23 has an electrical connection 24 to the ignition electrode 9.

The secondary winding 23 of the transformer means 21 is arranged, in the vicinity of the primary winding 22, around the lamp vessel 1. In this figure, the secondary winding 23, as well as the ignition electrode 9, is a tungsten track on the discharge vessel 1.

Figure 2:
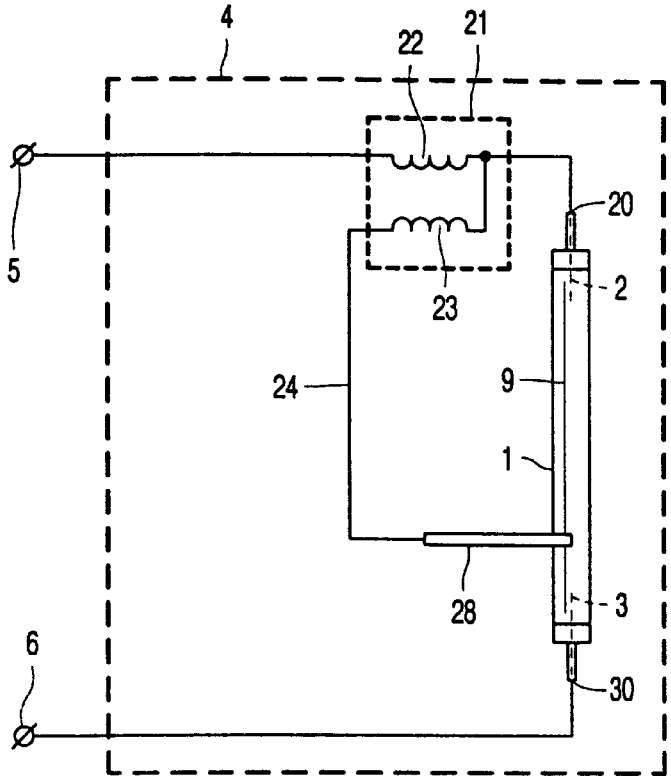
FIG. 2 schematically shows a second embodiment.
Figure 3:
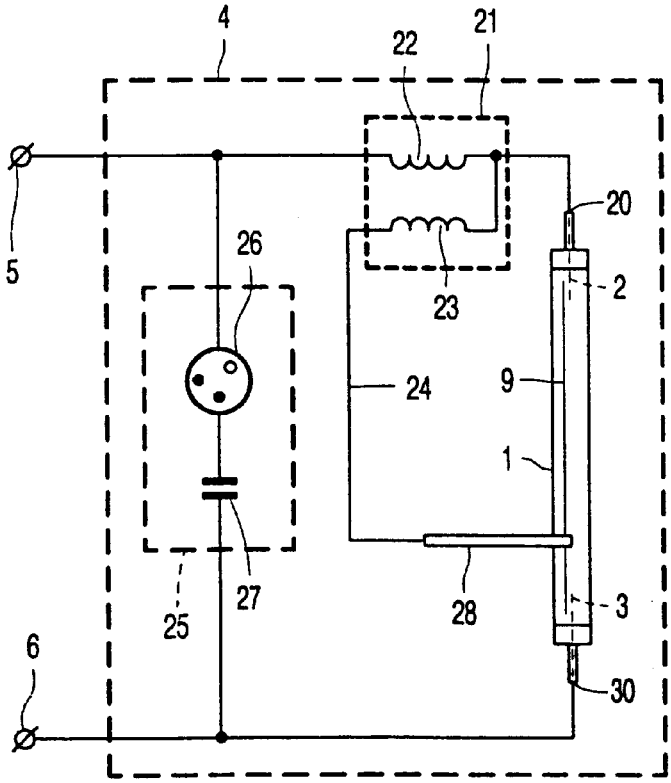
FIG. 3 schematically shows a third embodiment.

In FIGS. 2 and 3, corresponding components are denoted by the same reference numerals as in FIG. 1.

In FIG. 2, the primary winding 22 and the secondary winding 23 have an opposite inductive coupling.

The electric connection 24 between the ignition electrode 9 and the secondary winding 23 comprises a heat-sensitive element 28 which bears against the ignition electrode 9 but is high-ohmic during stable operation of the lamp. The heat-sensitive element 28 shown in the figure is a bimetal switch which, in the hot state, has interrupted the connection to the ignition electrode 9.

In a practical embodiment, the lamp shown is a high-pressure sodium discharge lamp which, during stable operation, has a power consumption of 400 W. The lamp vessel 1 contains a filling composed of 50 mg Na-amalgam with 18% by weight Na and Xe as a buffer gas with a filling pressure of 53 kPa (400 torr). The outer envelope of the lamp encloses a vacuum. The lamp is provided with an E27 lamp cap.

The lamp can suitably be operated by an external ignition device. The ignition device will generate a voltage pulse on the conductors 7, 8 and, via the connection points 20, 30, between the electrodes 2, 3. In addition, the voltage pulse will be transferred to the ignition electrode 9 by means of the transformer windings 22, 23. The windings 22, 23 of the transformer 21 have a winding ratio of 7:13 and a common air core. This leads to an additional increase of the voltage and hence the field strength between the ignition electrode and the second electrode. As a result, flashover takes place in the ionizable filling of the lamp vessel 1, thus causing the lamp to ignite. In a practical embodiment, the lamp ignites in a reliable manner if the ignition circuit supplies a voltage pulse of 1.4 kV. A comparable lamp in accordance with the state of the art has an ignition voltage of 2.5 kV if the filling pressure of the Xe buffer gas is limited to 33 kPa (250 torr). This means that this lamp ignites in a reliable manner when an ignition voltage pulse of 2.5 kV is applied to the external contacts of the E27 lamp cap.

In a comparable lamp in accordance with the invention, whose construction is shown in FIG. 1, the secondary winding 23 as well as the ignition electrode 9, are provided in the form of a tungsten track on the discharge vessel by means of sintering. The primary and the secondary winding each consist of 5 turns wound in mutually opposite directions. The lamp ignites in a reliable manner at an ignition voltage of 2 kV on the external contacts of the lamp cap.

The lamp shown in FIG. 3 comprises a starter 25 which electrically bridge the lamp vessel 1 and the transformer 21. The starter 25 includes a glow discharge starter 26 which is connected in series with a capacitor 27. The starter 25 is situated in the outer envelope 4 and supplies a voltage pulse across the electrodes 2, 3 via the primary winding 22. As starter 25, the glow discharge starter 26 and the capacitor 27 can be jointly replaced by a VDC (voltage-dependent capacitor).

We claim:

1. A high-pressure discharge lamp comprising:

a light-transmitting lamp vessel which is closed in a gastight manner and which is provided with connection points;

a first electrode and a second electrode which are arranged opposite each other and which are connected to respective connection points, and an ionizable filling in the lamp vessel;

a light-transmitting outer envelope around the lamp vessel, which envelope is provided with a lamp cap and is closed in a gastight manner;

a first external contact and a second external contact at the lamp cap for connecting the lamp to a supply device;

a first current conductor and a second current conductor connecting, respectively, the first electrode and the second electrode via respective connection points to, respectively, the first external contact and the second external contact;

an ignition electrode between the first electrode and the second electrode;

transformer means for generating a voltage pulse on the ignition electrode, wherein said transformer means comprising a primary winding arranged within the outer envelope in the first current conductor, and a secondary winding having an electrical connection to the ignition electrode; and a bimetal element incorporated in the electrical connection between the ignition electrode and the secondary winding, the bimetal element bearing against the ignition electrode during ignition, and interrupting the connection during stable operation of the lamp.

2. A high-pressure discharge lamp as claimed in claim 1, characterized in that the primary winding and the secondary winding have an opposite inductive linkage.

3. A high-pressure discharge lamp as claimed in claim 1 wherein the lamp has starter means which electrically bridge the lamp vessel and the transformer means.

4. A high-pressure discharge lamp as claimed in claim 3, characterized in that the starter means include a glow discharge starter.

5. A high-pressure discharge lamp as claimed in claim 4, characterized in that the starter means include a capacitor arranged in series with the glow discharge starter.

6. A high-pressure discharge lamp as claimed in claim 3, characterized in that the starter means include a voltage dependent capacitor.

7. A high-pressure discharge lamp as claimed in claim 1, wherein the ignition electrode is a tungsten track on the discharge vessel.

8. A high-pressure discharge lamp as claimed in claim 1, wherein the secondary winding of the transformer means in the vicinity of the primary winding is provided around the lamp vessel.

9. A high-pressure discharge lamp as claimed in claim 8, characterized in that the secondary winding is a tungsten track on the discharge vessel.

* * * * *